United States Patent [19]

Nwoko

[11] Patent Number: 4,916,833

[45] Date of Patent: Apr. 17, 1990

[54] ENHANCED SPEED LACING DEVICE WITH AN INTEGRATED ADJUSTABLE WIDTH, ADJUSTABLE TENSION SYSTEM

[76] Inventor: Luck Nwoko, 1629 Columbia Rd. NW. #110, Washington, D.C. 20009

[21] Appl. No.: 277,662

[22] Filed: Nov. 25, 1988

[51] Int. Cl.[4] ..... A43B 11/00; A43C 5/00

[52] U.S. Cl. ..... 36/50; 24/140

[58] Field of Search ..... 36/50; 24/140, 141, 24/146

[56] References Cited

U.S. PATENT DOCUMENTS

| | | | |
|---|---|---|---|
| 275,295 | 4/1883 | Train | 24/146 |
| 544,287 | 8/1895 | Cobb | 24/146 |
| 794,838 | 7/1905 | Baker | 24/141 |
| 1,384,565 | 7/1921 | Martin | 36/50 |
| 1,434,723 | 11/1922 | Triay, Jr. | 36/50 |
| 4,553,342 | 11/1985 | Derderian et al. | 24/140 |
| 4,642,913 | 2/1987 | Hase et al. | 36/50 |
| 4,670,949 | 6/1987 | Autry | 24/140 |

*Primary Examiner*—Steven N. Meyers

[57] ABSTRACT

An athletic shoe with an adjustable width, adjustable tension lacing device incorporated within a speedlace format is disclosed. The fastening device includes an eyelet-bearing body with two integrated eyelets, two communicating V-shaped notches which provides a unique mode of lace introduction, and oblique, upward placed guide grooves on the wide shoelace openings.

10 Claims, 4 Drawing Sheets

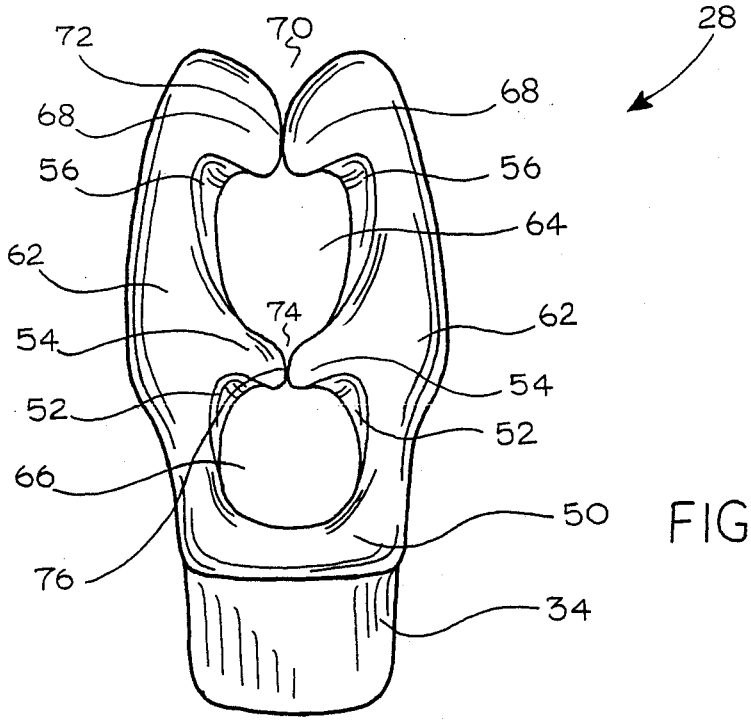
FIG. 3
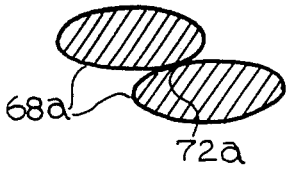
FIG. 5
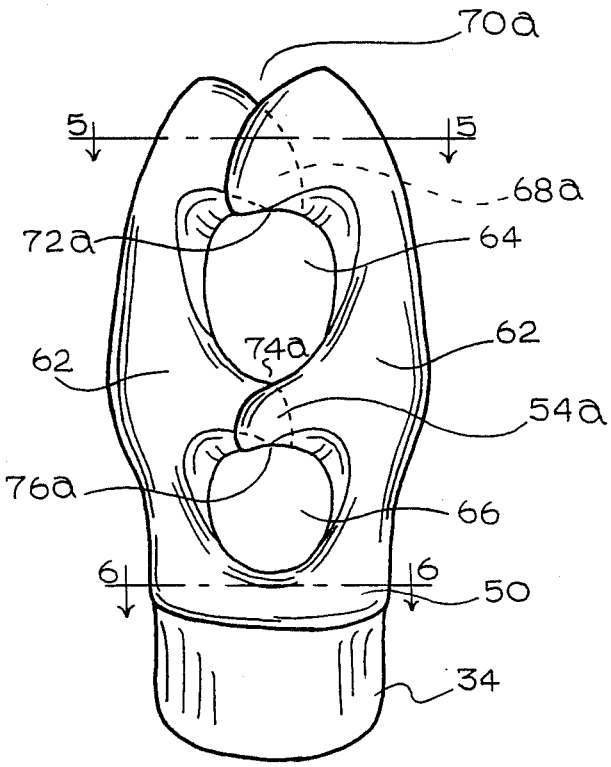
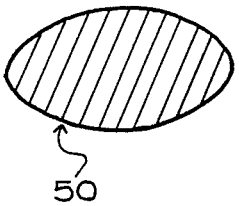
FIG. 6
FIG. 4

ENHANCED SPEED LACING DEVICE WITH AN INTEGRATED ADJUSTABLE WIDTH, ADJUSTABLE TENSION SYSTEM

TECHNICAL FIELD

This invention relates in general to fastening systems, and more particularly to athletic shoe speed lacing systems and to the application of a novel and improved speed lacing system which provides a unique mode of lace reception and an integrated adjustable width, adjustable tension system.

BACKGROUND OF THE INVENTION

Speed lacing devices have been used in athletic and outdoor activity shoes, such as in hiking and mountain or rock climbing shoes. Conventional speed lacing systems provide large pairs of eyelets which are wide enough to permit an unconstricted, uniform pull of the shoelace, and thus, provide rapid tightening of the lacing configuration. While uniformity is an admirable quality in speed lacing systems, extant speed lacing forms mostly provide the conventional mode of lace threading. And, most significantly, prior art speed lacing systems, even those that allow for tension and width adjustment, requires the shoe wearer to untie and unthread the shoelace before the shoelace can be rethreaded into the preferred width and tension adjusting eyelet.

The diversity in the anatomy of the human foot, such as high and low insteps, provides a logical incentive for the design and development of closure devices with integrated width and tension adjustment features. Furthermore, given that most athletic shoes are bought in sizes which allows the wearing of thick padded sports socks, and that these same athletic shoes are often times worn without thick socks, it is desirable to design athletic shoes with adjustable lacing systems; and, better yet, an adjustable width speed lacing system with a unique mode of lace reception.

SUMMARY OF THE INVENTION

The present invention relates to a speed lacing device for shoes which provides a novel and improved method of lace reception. The present invention is also directed to a secondary or subsidiary eyelet that provides adjustable width, and tension enhancement capacity as an integral part of the lacing device. The secondary eyelet is a continuum, albeit a bifurcated one, of the primary eyelet. The shoe includes a left and a right quarter and two kinds of eyelets, the eyelet-bearing lacing device of the present invention and conventional eyelets set on the right and left quarters. A plurality of pairs of the eyelet bearing lacing device are disposed along the left and right quarters, interposed between pairs of conventional eyelets. In a preferred embodiment, the eyelet-bearing lacing device is composed, in the anterior, of a pair of rigid, upwardly elongated, sinuous side members which curve inward to form primary and secondary hook members, primary and secondary flared, lace-introducing notches, communicating slits and primary and secondary eyelets. The integrated primary and secondary eyelets present openings large enough for the easy passage of a shoelace and are commonly referred to as speed lace forms.

In a preferred embodiment, the anterior body of the lacing device arises integrally from a rigid base member which in turn, forms an integral, downward extending, tapered lower extremity. The tapered, lower extremity or posterior is inserted into a slit and stitched to the upper along the throat. The visible portion of the lacing device, the body, faces inward toward the periphery of the throat.

Formed of one-piece plastic or metal material, about $\frac{1}{2}''$ (in the middle)$\times\frac{7}{8}''$, the body of the present invention is preferably of an oval cross-section with a thickened middle, while the lower portion is of a substantially constricted oval cross-section. The primary and secondary eyelets of the lacing device are formed by the curved or concaved inner edges of the sinuous, firm but pliant side members. These upwardly extended side members are solid throughout, yet of such length that they are inherently capable of lateral flexion and are adapted when a shoelace is introduced through the flared or V-shaped notches and communicating slits at the top of both eyelets.

The inside bights resulting from the curvature of the hook members are bevelled, oblique and upwardly placed. These bevelled grooves, particularly those on the uppermost or topmost side member provide placement and guidance to the shoelace that has been introduced into one of the eyelets and pulled taut in an upwardly diagonal manner.

The secondary eyelet of the present invention provides the width adjustment and enhanced lace tension capacity to the lacing system. The width adjustment capacity and the concomitant increased lacing pressure over the instep, for instance, is achieved by slipping a slack portion of the shoelace from the primary eyelet into the secondary eyelet via the secondary notch, and communicating slit. An adjustment that is achieved without having to unthread the shoelace.

An athletic shoe with an improved speed lacing system of the kind hereinabove described can be quickly and easily laced. Furthermore, unlike conventional speed lacing systems, the present invention provides an integrated, secondary eyelet, and based on the perpendicular alignment of the lacing device to the axis of the shoe throat, provides adjustment capacity along selected areas of the instep of the shoe.

The invention consists of several novel features which are hereinafter set forth and are more particularly defined by claims at the conclusion hereof.

For a better understanding of the invention and the advantages thereof, reference should be made to the following descriptive matter taken in conjunction with the accompanying drawings.

BRIEF DESCRIPTION OF THE DRAWINGS

FIG. 3 is an enlarged, elevated front view of an adjustable width lacing device according to the invention. The front view is a mirror-image of the back;

FIG. 4 is an enlarged, elevated front view of an adjustable width lacing device embodying another form of the invention. The front view is a mirror-image of the back;

FIG. 5 is an enlarged sectional view of FIG. 4 taken along line 5—5;

FIG. 6 is a sectional view of FIG. 4 along line 6—6.

DETAILED DESCRIPTION OF THE INVENTION

Figure 1:
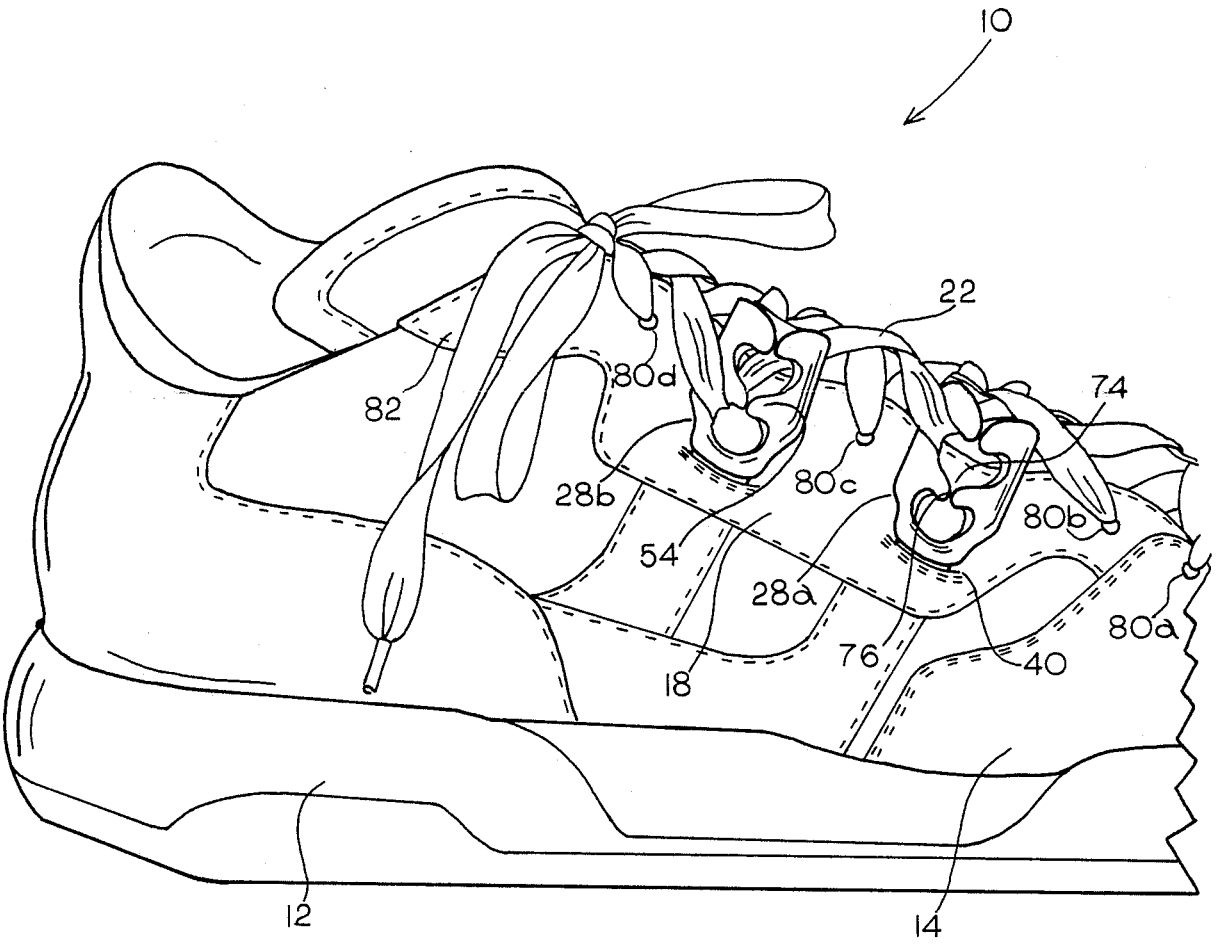
FIG. 1 is a perspective view of an athletic shoe embodying the invention, the shoe being laced using the most common configuration.

Referring now to the drawings, and more particularly to FIG. 1, there is shown an athletic shoe 10 in accordance with the present invention. Shoe 10 has a sole 12 to which is attached an upper 14. Upper 14 has a right quarter 18 and a left quarter 20 including a shoelace 22. Shoelace 22 is meant to fasten left quarter 20 to right quarter 18.

A width adjusting lacing device 28 is shown in FIG. 3 with a V-shaped lace introducing primary notch 70. Lacing device 28, with its double eyelets 64 and 66, is inserted, as substantially aligned, alternating lacing device pairs 28*a*–28*b* into slits 40 and stitched to reinforcing member 82 and upper 14. Lacing device 28 should preferably be constructed of one-piece, rigid but pliant plastic or metal material.

The two aligned pairs of lacing device 28, interposed with conventional eyelets 80, are arranged along opposing quarters 18 and 20. Primary eyelet 64 with its lace-introducing primary notch 70, slit 72, secondary notch 74, slit 76 and secondary eyelet 66 all face inward toward the shoe opening or throat. The two integrated eyelets, 64 and 66 are formed as a result of the curved or concaved inner edges of the laterally spaced, upwardly elongated, sinuous side members 62, each rising integrally from base member 50.

As shown in FIG. 3, the heart-shaped or top-dented configuration of primary eyelet 64 is due to the inward and downward curving hook members 68 which are a continuation of side members 62. Hook members 68 are smooth and outwardly bevelled or flared on convex lines, thus forming a V-shaped, lace-introducing primary notch 70. The entry of shoelace 22 into split 72 exerts lateral flexion on side members 62, parting to allow a portion of shoelace 22 to enter eyelet 64 laterally.

Splits 72 and 74 by entering eyelets 64 and 66 respectively in a narrow manner cannot be forced open by the strain of shoelace 22 once inside eyelets 64 or 66. Moreover, lace 22 is provided additional securement by the obliquely angled and bevelled grooves 56, or 52, when it is pulled upward in a taut diagonal manner. Groove members 56 and 54 are oblique and bevelled in the front and back, thus presenting a smooth, rounded surface to shoelace 22. It will be noted that in addition to serving as lace introducing elements, hook members 54 also form a small bridge between the primary and secondary eyelets.

The essentially straight alignment and integration of eyelet 66 to eyelet 64 provides the system with its width adjustment and enhanced lacing pressure capacity. Furthermore, shoelace opening 66, like opening 64, is wide sized so that it can loosely receive shoelace 22. The entry of shoelace 22 into slit 76 causes side members 62 to spring outward to the same extent; moreover, the inherent tensility of the plastic or metal composition of lacing device 28 provides for adequate compliancy.

FIG. 3 presents lacing device 28 in detail. The downward extending member 34 is an integral extension of base member 50. Lip member 34 is inserted into a slit 40 for attachment to the shoe upper.

Figure 2:
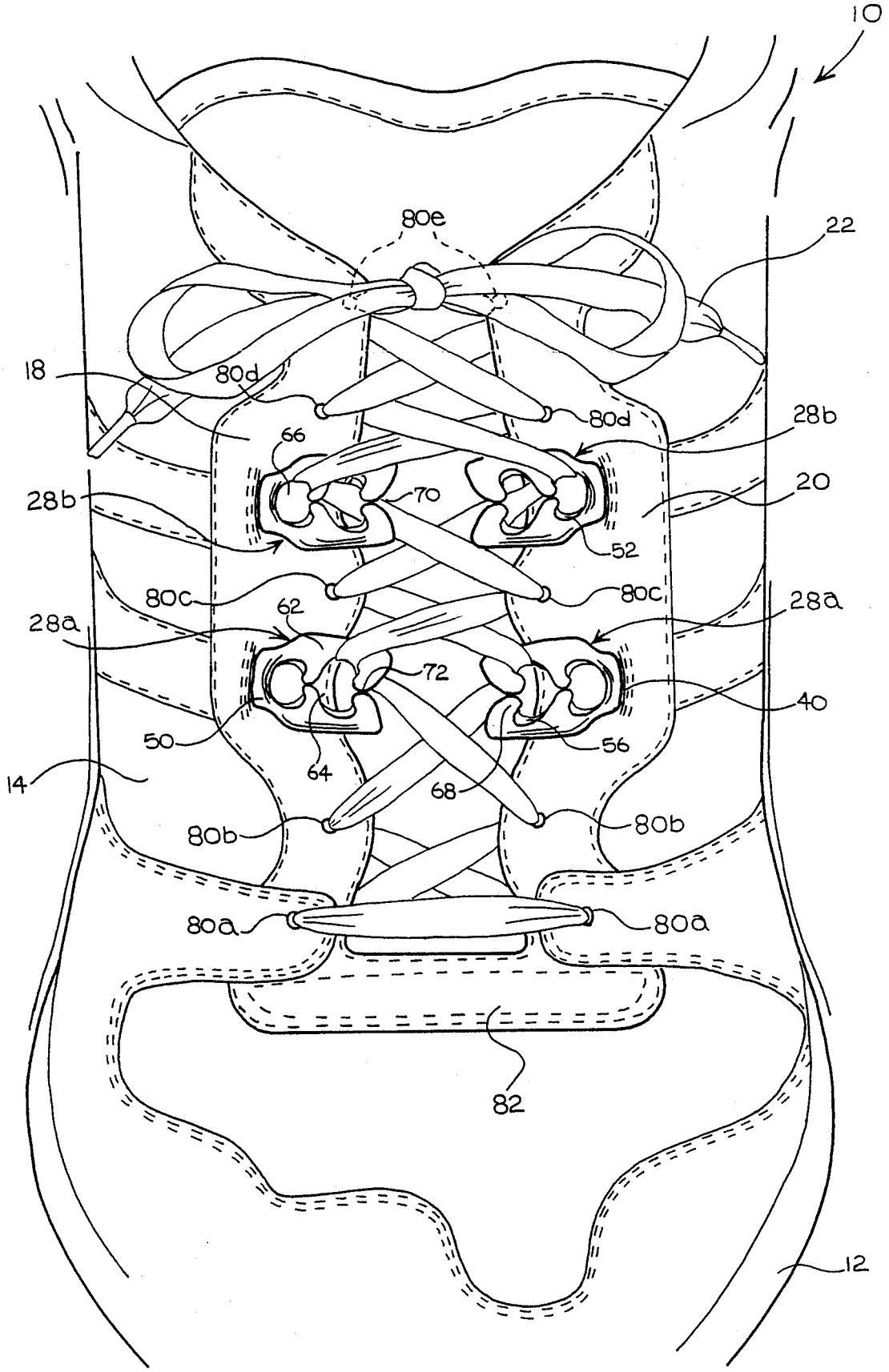
FIG. 2 is a top view of an athletic shoe embodying the invention.
Figure 7:
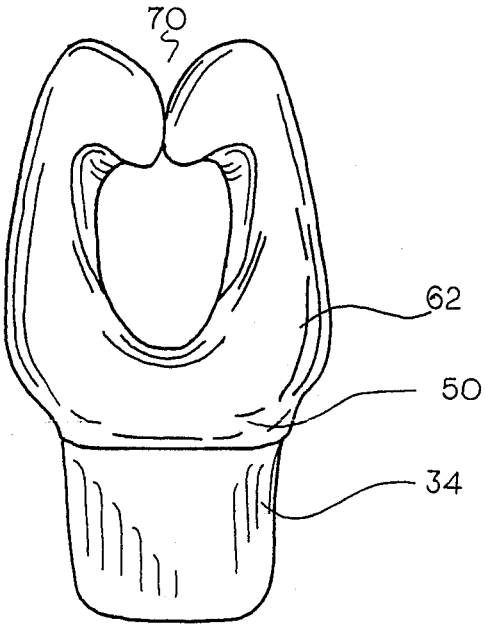
Figure 8:
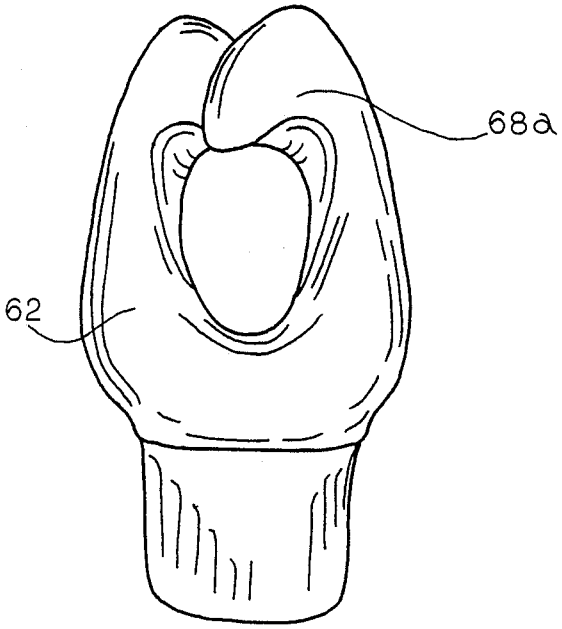

FIG. 2 shows shoe 10 with a lace portion of shoelace 22 laced in a "Z" pattern through the secondary eyelet of lacing device 28*b* thereby incorporating the closure elements increased tension capacity over the metatarsal area. A plurality of apertures or conventional eyelets 80, aligned in 80*a*–80*e* pairs, and interposing pairs of the lacing device, provides additional securement of shoelace 22 lacing configuration. Thus, for instance, the lacing of portions of shoelace 22 through the pairs of conventional eyelets, 80*c* and 80*d*, below and above lacing device pair 28*b*, further consolidates the increased lacing tension. Consolidation of the desired set tension by the relatively small holes 80 is due to the grip and friction exerted by the small apertures on shoelace 22. Holes 80 are formed through upper 14 and reinforcing member 82 along the periphery of the shoe opening.

Although the invention has been described with reference to a particular embodiment, other configurations can be made without departing from or sacrificing any of the advantages of the invention. For example, in a modified form (FIG. 4) it will be seen that the hook elements 68*a* overlap one another so that their curved or concave inner edges combine to from the lace engaging primary eyelet 64. Instead of the slit 72, lapped elements 68*a* form a normally closed joint 72*a* (FIG. 5). The V-shaped notch 70*a* is smaller than notch 70, but sufficiently large to engage with the shoelace in such a manner as to separate the hook members 68*a* and permit the lace to pass between them into primary eyelet 64. Also in this embodiment, the relatively smaller hook elements 54*a* overlap to serve as lace introducing elements, forming notch 74*a*. The normally closed joint 76*a* formed by lapped elements 54*a* allows an introduced portion of the shoelace to separate lapped elements 54*a* and permit the reception of the shoelace portion by the secondary eyelet.

As a result of lapped hook elements 68*a* and 54*a*, and the substantially rounded shoulders or bevelled grooves 56 and 52, it will be seen that the shoelace cannot accidentally pass laterally from the eyelets of the lacing device. In addition to security, the oblique angulation of the bevelled grooves 56 and 52, particularly those on the uppermost side member, provide guidance to a shoelace pulled upwards in a taut diagonal manner.

Referring to the modified form of lacing device 28 shown in FIG. 4, it will be seen that primary eyelet 64, and secondary eyelet 66 are both large enough to loosely receive the threaded shoelace.

The modified form, like the original, should be made of one-piece plastic or metal material, with an oval, thickened middle cross-section (FIG. 6). Lapped, hook members 68*a* and 54*a* and side members 62 are an integral upward extension of base member 50, which also extends downwardly as tapered member 34. It will be noted that secondary eyelet 66, provides width adjustment and increased lacing tension capacity to the fastening system. This capacity is achieved by passing the shoelace through normally closed joint 76*a* into a wide receiving secondary eyelet 66. The innate flexibility or elasticity of lapped hook members 54*a* and 68*a* and side members 62 provides the required flexion or springout capacity to the system.

An improved lacing system of the kind hereinabove described can be quickly and easily threaded by the use of its novel, flared, lace-introducing notches. A further enhancing feature of the present invention, through the use of the integrated secondary eyelet, is the width and tension adjustment capacity. Moreover, by attaching along the periphery of the shoe opening a paired plurality of the lacing device in staggered pacing, interposed with a paired plurality of conventional eyelets, a multiplicity of staggered lacing patterns maybe employed to achieve the best fitting lacing configuration. This enhanced capacity for metatarsal area adjustment is most crucial to shoe wearers with high or low insteps. Although shown with an athletic shoe, the invention is not limited to athletic shoes.

While particular embodiments of the present invention have been disclosed, it is to be understood that various changes may be made in the embodiment of the invention herein specifically described, without, departing from the true spirit and scope of the appended claims, and nothing herein shall be construed as limitations upon the invention, its concept or structural embodiment as to the whole or any part thereof. For example, the invention, in the preferred forms illustrated, can be made with only one eyelet, or with a plurality of integrated eyelets. Furthermore, in addition to articles of footwear, the present invention can be used as a fastening element for clothing and other related items such as suspenders, belts, gloves, handbags, and so forth.

I claim:

1. A lacing device, for attachment along the periphery of the throat of an article of footwear to uniquely receive and provide guidance to shoelaces of a lacing configuration, comprising:

An integral, eyelet-bearing lacing device adapted to be attached along the periphery of the shoe throat, said lacing device provided with a pair of rigid, upwardly elongated, laterally spaced, sinuous side members, said side members curving inwards and downwards at the top along convex lines to form outwardly bevelled, converging primary hook members, said convex line configuration of said primary hook members resulting in the formation of a V-shaped, lace-introducing primary notch;

said primary notch communicating with a central slit which leads into a primary eyelet, said primary eyelet having an opening large enough to loosely receive a shoelace, and formed on each side of said primary eyelet, front and back, a substantially bevelled, oblique upward groove which provides security and guidance, to said shoelace drawn taut in a diagonal manner;

a pair of upwardly bevelled, converging secondary hook members, said secondary hook members curving inwardly and downwardly along convex lines and being extensions of said side members as well as circumscribing a downward interior portion of said primary eyelet, convex line configuration of said secondary hook members creating a flared, lace-introducing secondary notch, said secondary notch being sufficiently wide to engage said shoelace and communicating with a central slit which leads into a secondary eyelet, said secondary eyelet having an opening large enough to loosely receive said shoelace, and formed on each side of said secondary eyelet, front and back, a substantially bevelled, oblique, upward groove which provides security and guidance, to said shoelace when drawn taut in a diagonal manner.

2. A lacing device of claim 1 wherein said upwardly elongated, sinuous side members arise integrally from a rigid base member which also circumscribes the downward interior portion of said secondary eyelet.

3. A lacing device of claim 2 wherein said base member forms an integral, downward extending member, said downward member being rigid and tapered.

4. A lacing device of claim 1 wherein said secondary eyelet being a bridged but communicating extension of said primary eyelet provides width and tension adjustment capacity to the lacing system.

5. A lacing device of claim 1 wherein said elongated side members being formed of plastic or metal material are inherently capable of lateral flexion and are adapted when said shoeless is introduced through said flared notches.

6. A lacing device of claim 1 wherein said eyelet grooves being angulated and bevelled on both sides provides a smooth rounded surface to said shoelace.

7. A lacing device of claim 1 wherein a visible anterior portion of said lacing device faces inward toward the periphery of said throat.

8. A lacing device of claim 1, wherein said slits enter said primary and secondary eyelets in a narrow manner, and thus resists opening by the strain of said shoelace once inside said eyelet.

9. A lacing device for attachment along the periphery of the throat of an article of footwear to uniquely receive and provide guidance to laces of a lacing configuration, said lacing device provided with a pair of rigid, upwardly elongated, laterally spaced, sinuous side members, said side members curving inwards and downwards at the top along convex lines to form outwardly bevelled primary hook members which overlap one another to form a lace-introducing flared notch and a normally closed joint which separates said overlapping hook members when engaged by a lace, and permits said lace to pass between said overlapping hook members into a primary eyelet;

said primary eyelet having an opening large enough to loosely receive a shoelace, and formed on each side of said primary eyelet, front and back a substantially bevelled, oblique, upward groove which provides security and guidance to said shoelace drawn taut in a diagonal manner;

a pair of bevelled, overlapping secondary hook members, said overlapping secondary hook members curving inwardly and downwardly along convex lines and being extensions of said side members as well as circumscribing a downwardly interior portion of said primary eyelet, said overlapping secondary hook members also form a lace-introducing flared notch and normally closed joint which separates said overlapping secondary hook members when engaged by said lace, and permits said lace to pass between said overlapping secondary hook members into a secondary eyelet, said secondary eyelet having an opening large enough to loosely receive said lace, and forming on each side of said secondary eyelet, front and back, a substantially bevelled, oblique up ward groove which provides security and guidance to said lace when drawn taut in a diagonal manner;

said upwardly elongated, sinuous side members arising integrally from a rigid base member which also circumscribes the downward interior portion of said secondary eyelet, said base member further forms an integral, downward extending member, said downward member being rigid and tapered.

10. A lacing device for attachment along the periphery of the thread of an article of footwear to uniquely receive and provide guidance to laces of a lacing configuration, said lacing device provided with a pair of rigid, upwardly elongated, laterally spaced, sinuous side members, said side members curving inwards and downwards at the top along convex lines to form outwardly bevelled primary hook members which overlap one another to form a lace-introducing flared notch and a normally closed joint which separates said overlapping hook members when engaged by a lace, and permits said lace to pass between said overlapping hook members into a primary eyelet;

said primary eyelet having an opening large enough to loosely receive a shoelace, and formed on each side of said primary eyelet, front and back, a substantially bevelled, oblique, upward groove which provides security and guidance to said shoelace drawn taut in a diagonal manner;

said upwardly elongated, sinuous side members arising integrally from a rigid base member which also circumscribes a downward interior portion of said primary eyelet, said base member further forms an integral, downwardly extending member, said downward member being rigid and tapered.

* * * * *